US006132001A

United States Patent [19]

Su

[11] Patent Number: 6,132,001

[45] Date of Patent: Oct. 17, 2000

[54] ADJUSTMENT DEVICE FOR AN ARM OF A CHAIR

[76] Inventor: Wen-Fa Su, No. 26, Hsing Ya Road, Chia Yi, Taiwan

[21] Appl. No.: 09/500,031

[22] Filed: Feb. 8, 2000

[51] Int. Cl.[7] ..... A47C 7/54

[52] U.S. Cl. ..... 297/411.36; 248/161

[58] Field of Search ..... 297/410, 411.36, 297/453, 344.18, 344.2; 248/118, 118.3, 157, 161

[56] References Cited

U.S. PATENT DOCUMENTS

| | | | |
|---|---|---|---|
| 4,668,014 | 5/1987 | Boisset | 297/410 X |
| 4,951,995 | 8/1990 | Teppo et al. | 297/411.36 |
| 5,647,638 | 7/1997 | Ritt et al. | 297/411.36 |
| 5,667,277 | 9/1997 | Van De Riet | 297/411.36 |
| 5,795,026 | 8/1998 | Dral et al. | 297/411.36 |

*Primary Examiner*—Peter R. Brown

*Attorney, Agent, or Firm*—Rosenberg, Klein & Lee

[57] ABSTRACT

An adjustment device for an arm of a chair comprises a fixed tube member, an inner tube and an adjustment member. The fixed tube member is fixed to an upper side of the seat of the chair, and has rows of teeth on upright trenches on inner side thereof. The inner tube is movably received in the fixed tube member, and connected to the arm from an upper end. The adjustment member is fixed to an intermediate portion of the inner tube, and has cogs turnably disposed the teeth of the fixed tube member. An engaging member is movably disposed on the cogs; the engaging member is biased downwardly by a spring, and connected to a rope of a controlling member such that same can be lifted by pushing the controlling member. The engaging member has engaging teeth opposing the cogs such that the cogs are stopped from turning for fixing the adjustment member and the arm in position when the engaging member is not lifted. When the engaging member is lifted, the cogs can turn, permitting the arm to be adjusted to a desired position.

3 Claims, 9 Drawing Sheets

ADJUSTMENT DEVICE FOR AN ARM OF A CHAIR

BACKGROUND OF THE INVENTION

Chairs having arms adjustable in respect of height are very popular because the sitter can rest their arms comfortably on the chair arms having been adjusted to a desired height.

Many adjustment devices for an arm of a chair have be devised, e.g. the ones disclosed in U.S. Pat. Nos. 5,853,223, 5,795,026, 4,828,323 and 4,239,282.

The inventor of the present invention has devised an adjustment device for an arm of a chair, which has a design different from those of the above said devices, and can be used easily.

SUMMARY OF THE INVENTION

It is a main object of the present invention to provide an adjustment device for an arm of a chair which can be used easily.

The adjustment device of the present invention comprises:

a fixed tube member fixed to an upper side of a seat of the chair; the fixed tube member having rows of teeth on upright trenches on inner side thereof;

an inner tube having a lower part movably received in the fixed tube member;

an upper part of the inner tube being coupled to the arm of the chair;

an adjustment member connected to a middle portion of the inner tube; the adjustment member having cogs each turnably disposed on a respective row of teeth of the fixed tube member; the adjustment member having an engaging member disposed on the cogs; the engaging member being biased downwards by a spring to connect the cogs such that the cogs are stopped from turning for fixing the adjustment member, the inner tube and the arm in position; the engaging member being connected to rope from a controlling member movably fitted to the arm such that the engaging member can be separated from the cogs when the controlling member is moved to lift the engaging member, permitting the adjustment member, the inner tube, and the arm to be adjusted in respect of height.

BRIEF DESCRIPTION OF THE DRAWINGS

The present invention will be better understood by reference to the accompanying drawings, wherein.

DESCRIPTION OF THE PREFERRED EMBODIMENTS

Figure 1:
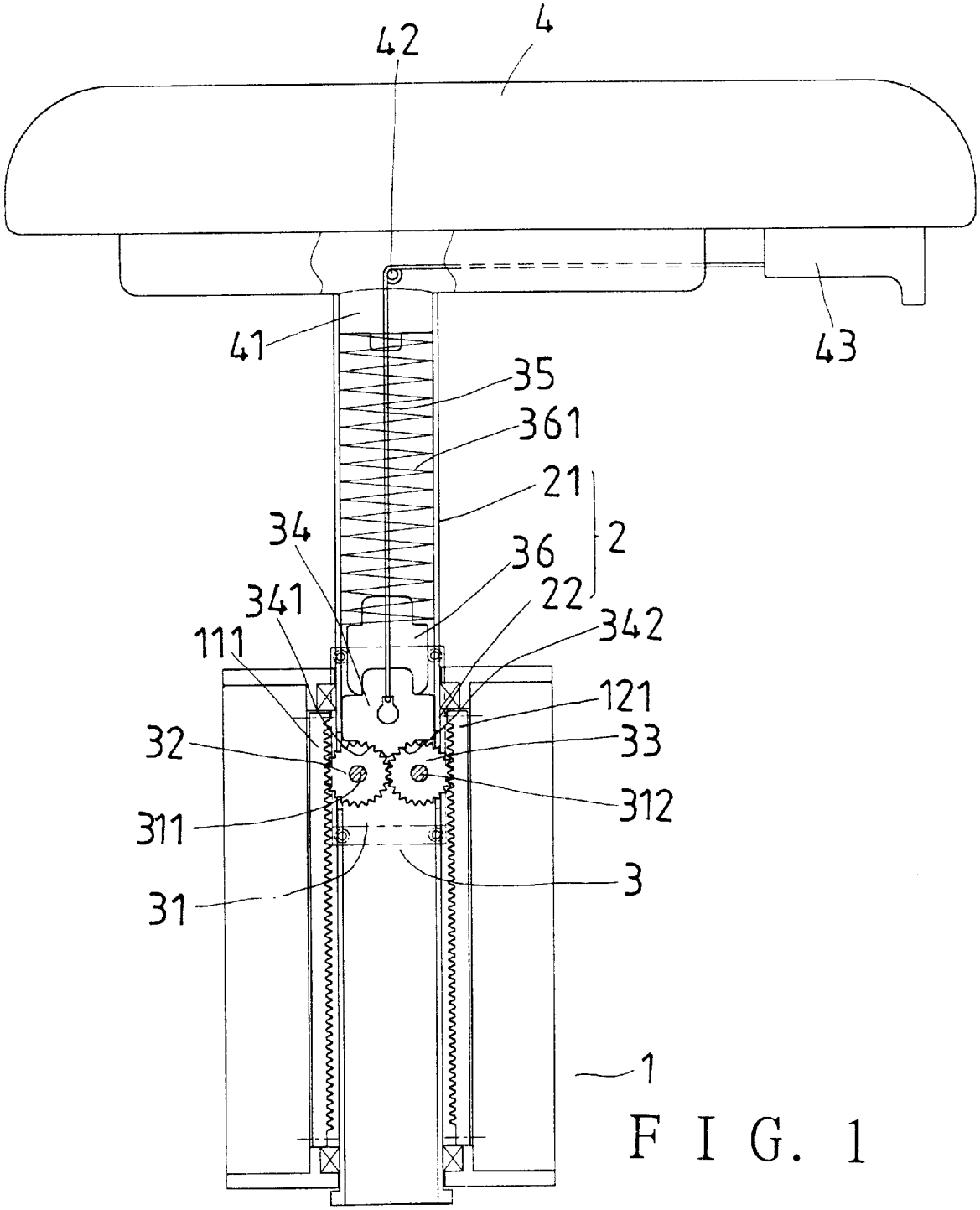
FIG. 1 is a cross-sectional view of the adjustment device and the arm according to the first embodiment of the present invention.

Referring to FIG. 1, an adjustment device for an arm 4 of a chair of the first embodiment of the present invention comprises a fixed tube member 1, an inner tube 2 and an adjustment member 3 as the main parts.

Figure 2:
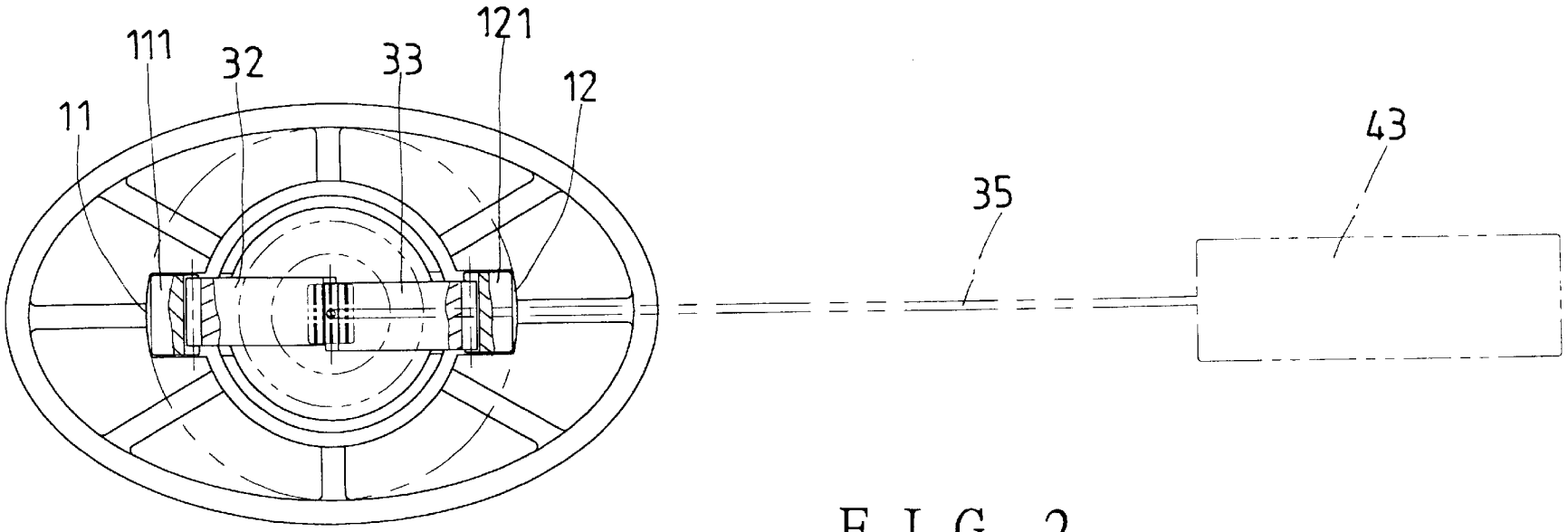
FIG. 2 is a cross-sectional view of the fixed tube member of the adjustment device in FIG. 1.
Figure 3:
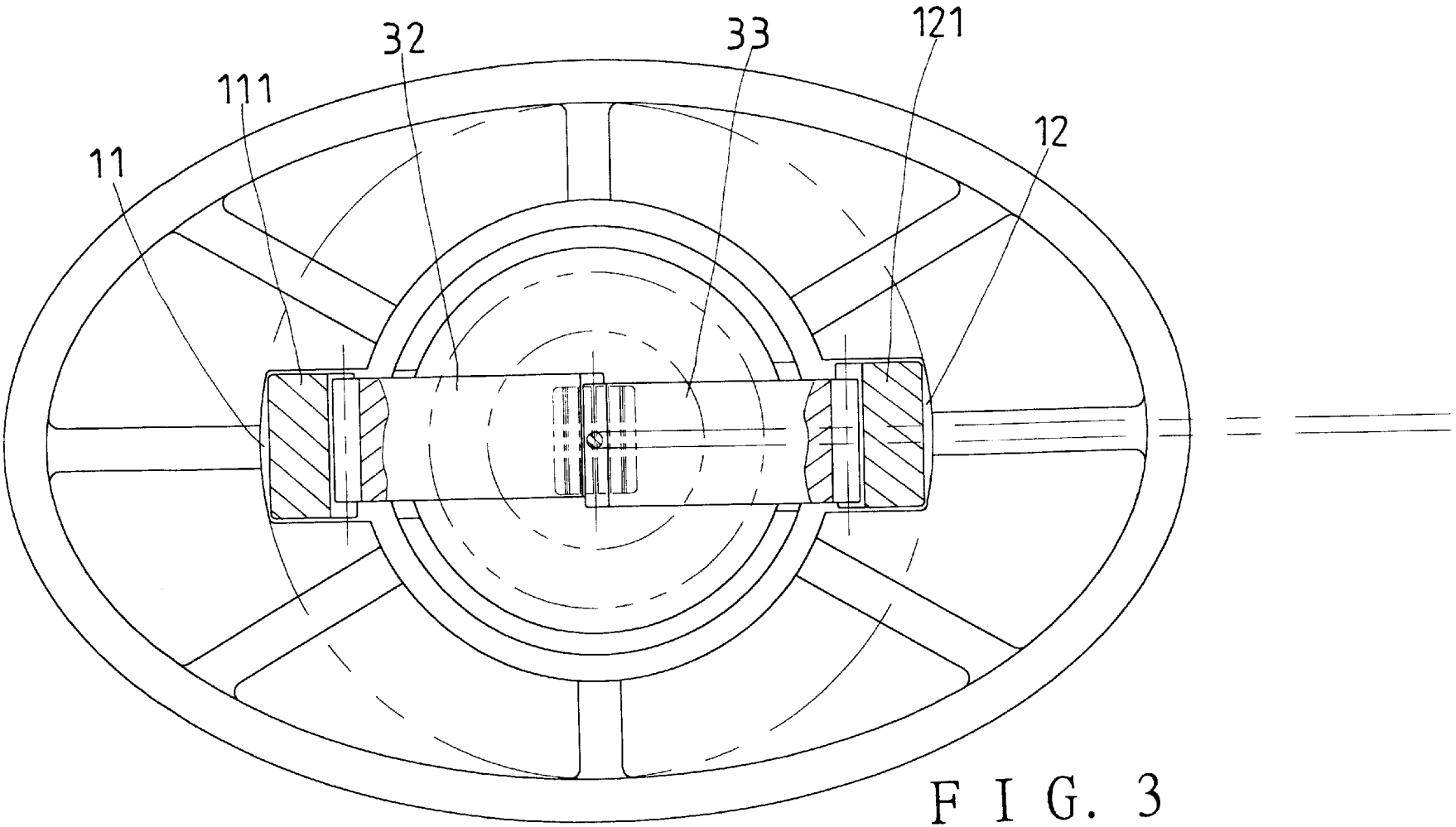
FIG. 3 is a fragmentary cross-sectional view of the fixed tube member of the adjustment device in FIG. 1.
Figure 4:
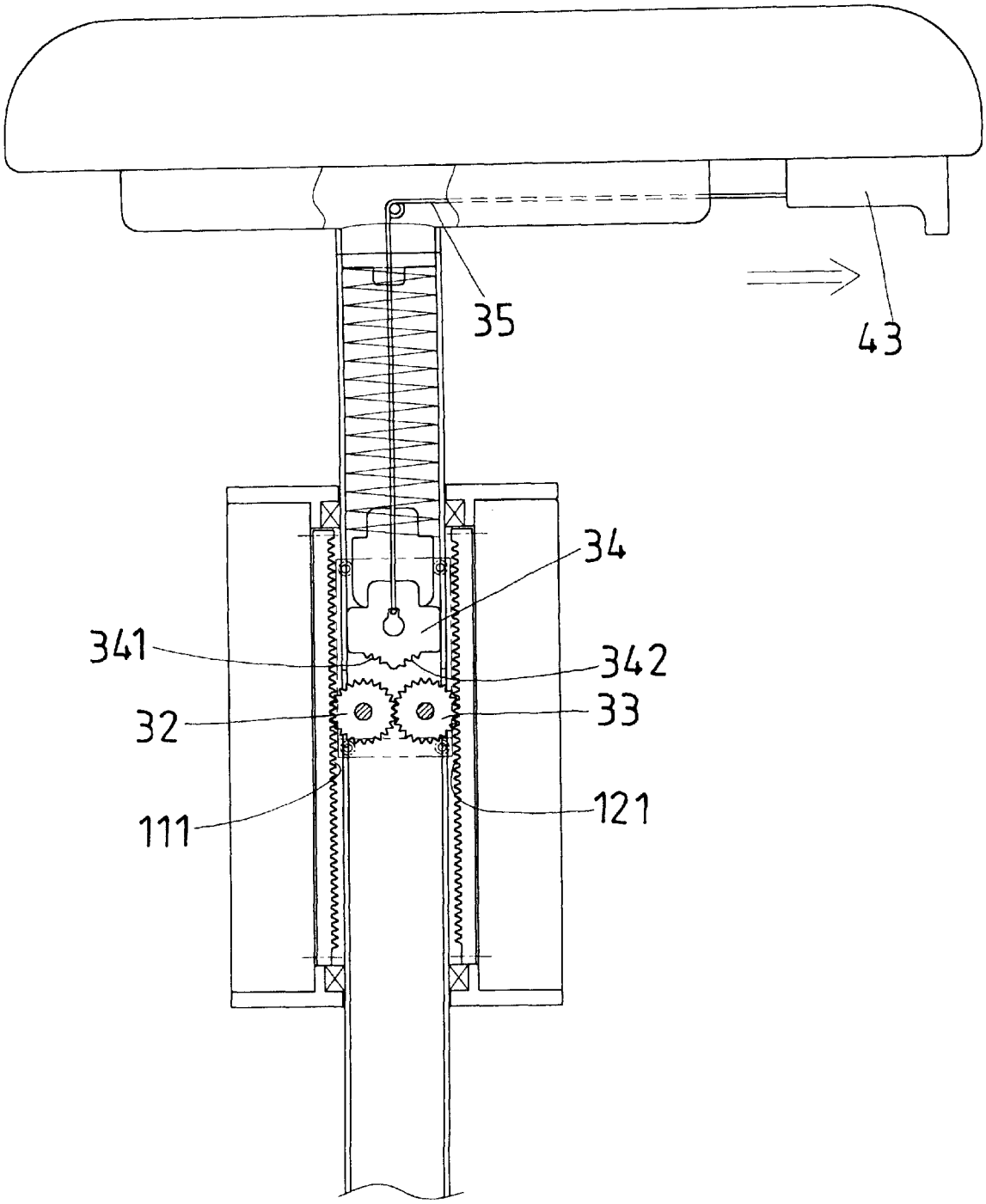
FIG. 4 is a view showing the adjustment device and the arm in FIG. 1 under a first step of the adjustment movement.
Figure 5:
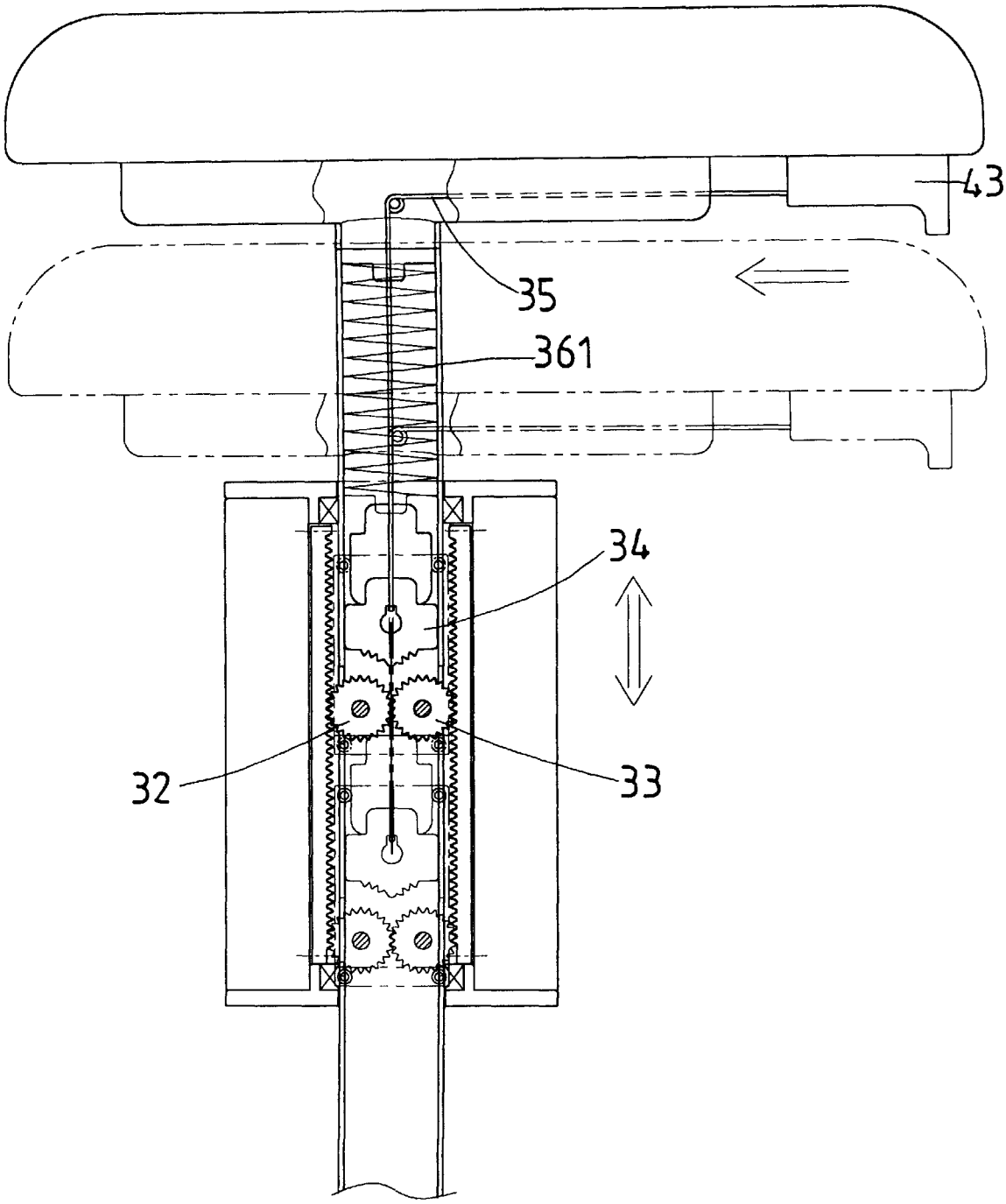
FIG. 5 is a view showing the adjustment device and the arm in FIG. 1 under a second step of the adjustment movement.

The fixed tube member 1 is fixed to an upper side of the seat of the chair. The fixed tube member 1 has two opposing upright straight trenches 11, 12 on an inner side thereof, the trenches 11, 12 each has lined teeth 111, 121 thereon, as shown in FIGS. 2 and 3.

The inner tube 2 consists of an upper part 21 and a lower part 22. The inner tube lower part 22 is movably received in the fixed tube member 1.

The adjustment member 3 has a housing body 31. The housing body 31 is connected to both the upper part 21 and the lower part 22 of the inner tube 2. The housing body 31 has two cogs 32, 33 supported by pivot rods 311, 312 respectively. The cogs 32, 33 are each turnably disposed on a respective one of the lined teeth 111, 121 of the fixed tube member 1. The adjustment member 3 further has an engaging member 34 having engaging teeth 341, 342 on a lower side thereof The engaging member 34 is movably disposed on upper side of the cogs 32, 33 with the engaging teeth 341, 342 separably engaging the cogs 32, 33 respectively. A locating block 36 is connected to upper side of the engaging member 34. A spring 361 is received in the upper part 21 of the inner tube 2 with a lower end portion thereof located by the locating block 36.

The inner tube upper part 21 is further connected to a lower side of the arm 4 with a locating block 41 coupled to the upper end thereof An upper end portion of the spring 361 is located by the locating block 41 such that the spring 361 biases the engaging member 34 downwardly for the engaging teeth 341, 342 of the engaging member 34 to engage the cogs 32, 33.

A rope 35 is connected to the engaging member 34, and a controlling member 43 movably disposed under the arm; a turnable rod 42 is provided under the arm to support the rope 35. Thus, the controlling member 43 can be pushed in order for the engaging member 34 to be lifted.

To adjust the arm of the chair, the controlling member 43 is pushed to lift the engaging member 34 for the engaging teeth 341, 342 to separate from the cogs 32, 33. Thus, the cogs 32, 33 can turn and move along, the lined teeth 111, 121 of fixed tube member 1, permitting the inner tube 2 to be moved along the fixed tube member 1. Thus, the arm 4 is adjusted in respect of its height. When the arm 4 is moved to a desired position, the controlling member 43 is released for the engaging member 34 to be forced to move downwards by the spring 361. Thus, the engaging teeth 341, 342 engage the cogs 32, 33 again, and fix both the adjustment member 3 and the inner tube 2 in position.

Figure 6:
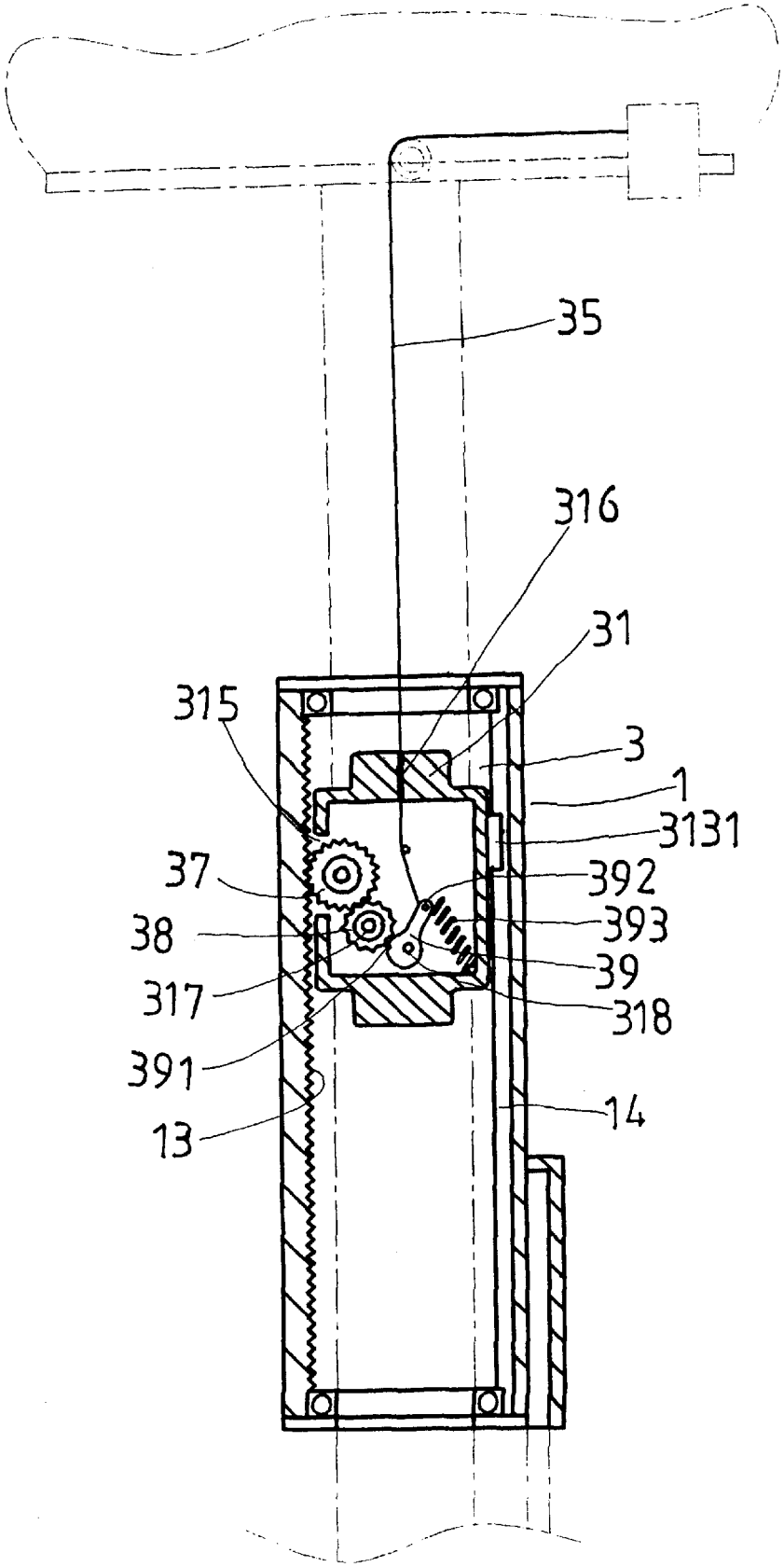
FIG. 6 is a cross-sectional view of the adjustment device according to a second embodiment of the present invention.
Figure 7:
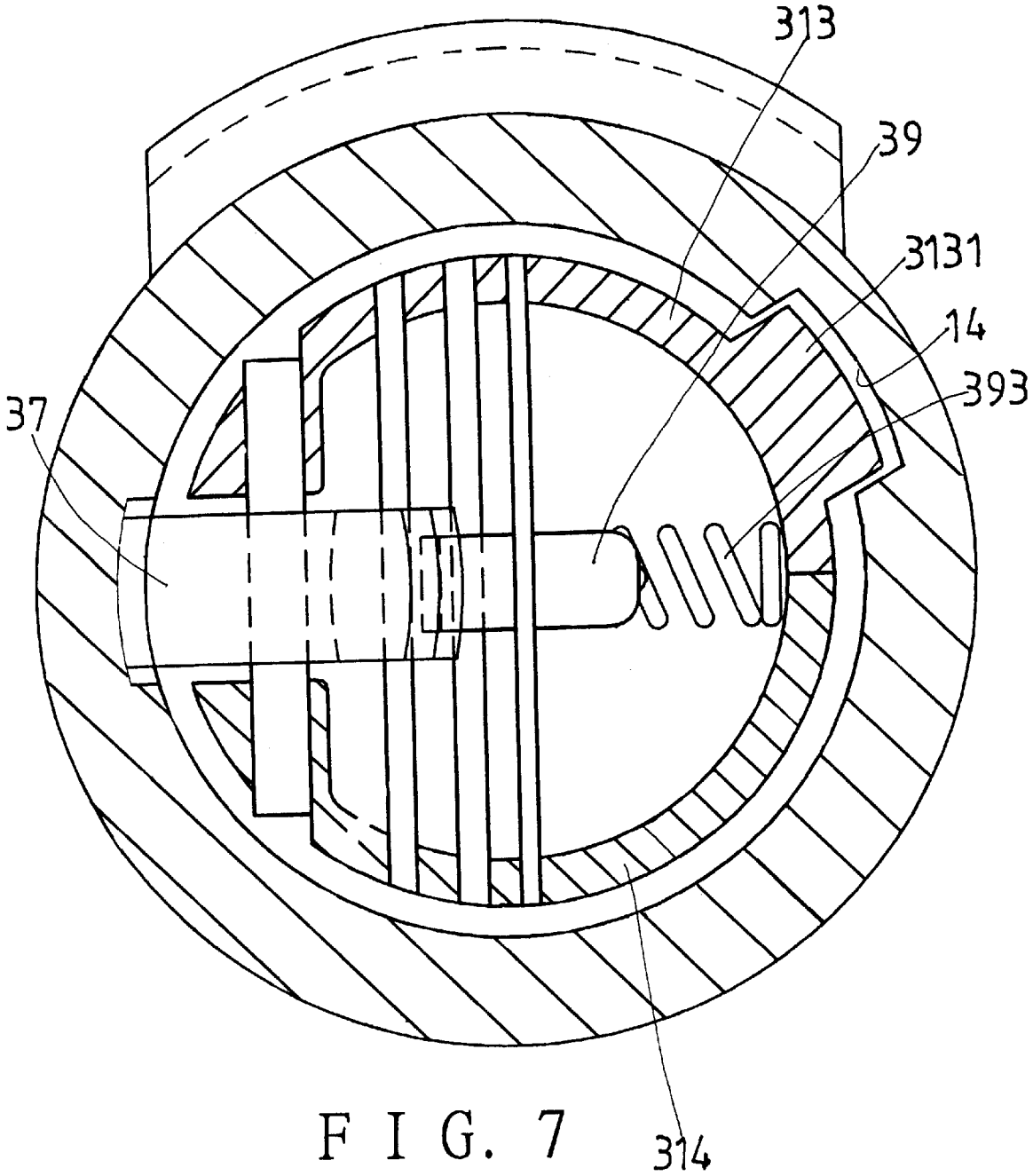
FIG. 7 is a top view of the adjustment device in FIG. 6.
Figure 8:
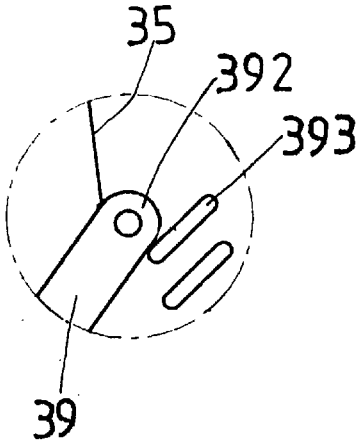
FIG. 8 is a fragmentary view of the adjustment device in FIG. 6.
Figure 9:
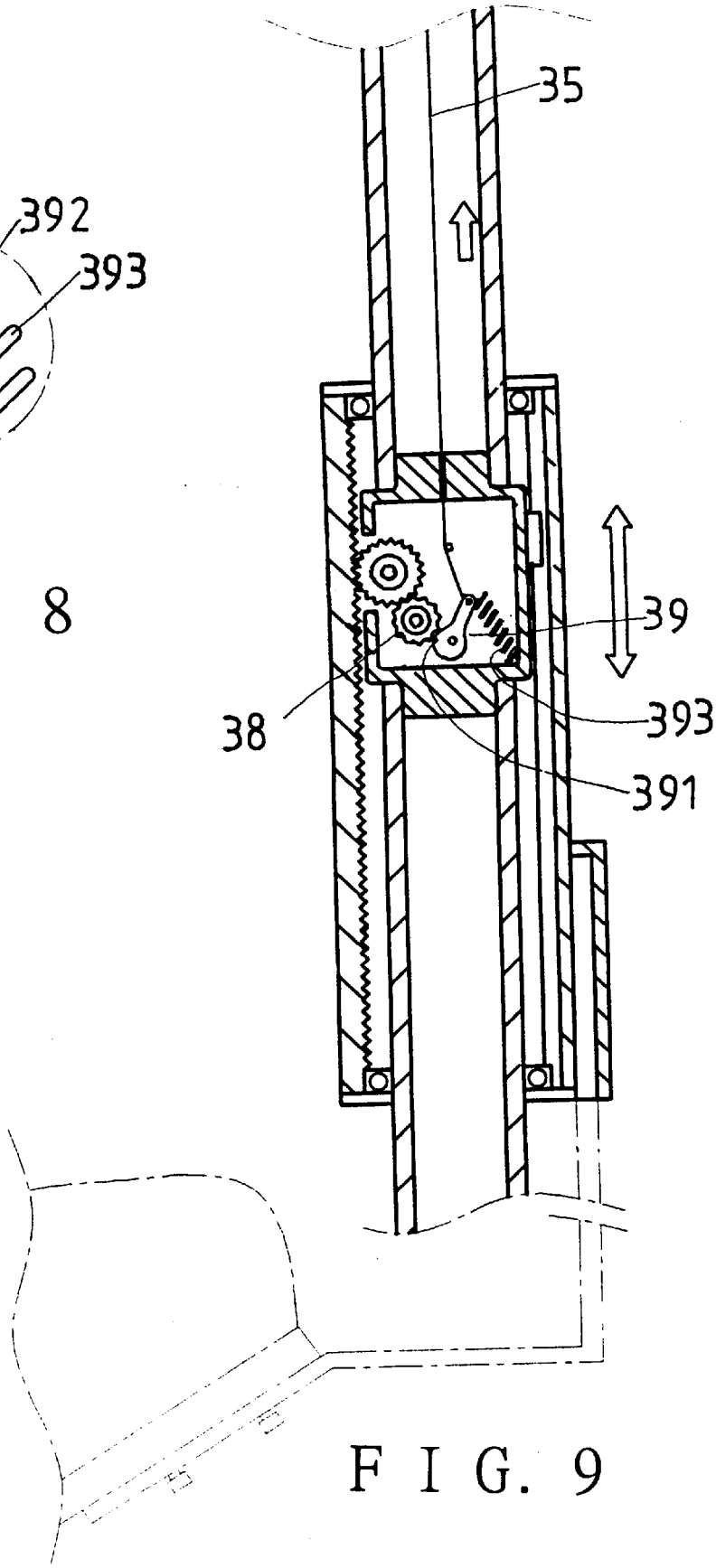
FIG. 9 is a view showing the adjustment device in FIG. 6 under adjustment movement.

Referring to FIGS. 6, 7 and 8, in a second embodiment of the present invention, the adjustment device comprises a fixed tube member 1, an inner tube 2 and an adjustment member 3. The fixed tube member 1 has a row of lined teeth 13 and an upright confining trench 14 on inner side thereof. The adjustment member 3 has a housing body 31 consisting of a left side part 313 and a right side part 314 coupled to the left side part 313. A gap 315 is formed on the housing body 31. The housing body 31 further has a protruding block 3131 on the left side part 313. The protruding block 3131 is movably received in the confining trench 14 of the fixed tube member 1 such that the adjustment member 3 can move stably along the fixed tube member 1.

The adjustment member 3 has a first cog 37, an intermediate cog 38 and a controlling lever 39 received therein. The first cog 37 projects out from the gap 315, and is turnably disposed on the lined teeth 13 of the fixed tube member 1. The intermediate cog 38 is supported by, and can turn on a support rod 317; the intermediate cog 38 is disposed between the first cog 37 and the controlling lever 39 with teeth thereof engaging teeth of the first cog 37. The controlling lever 39 is pivoted on a pivot rod 318, and has engaging teeth 391 and a pulled end 392. A spring 393 is connected to the pulled end 392 and the housing body 31 to bias the pulled end 392 downwardly. A rope 35 is connected to the pulled end 392 and a controlling member same as the controlling member 43 in FIG. 1 such that when the controlling member 43 is pushed by a user, the pulled end 392 can be lifted. A through hole 316 is provided on the housing body 31 for the rope 35 to be passed therethrough. When the pulled end 392 of the controlling lever 39 is not lifted the spring will force the engaging teeth 391 to engage the intermediate cog 38 for preventing the cogs 37 and 38 from turning. To adjust the arm, the controlling member 43 is pushed for the engaging teeth 391 of the controlling lever 39 to separate from the intermediate cog 38. Thus, the cogs 37 and 38 can turn for permitting both the inner tube 2 and the adjustment member 3 to be moved along the fixed tube member 1.

Figure 10:
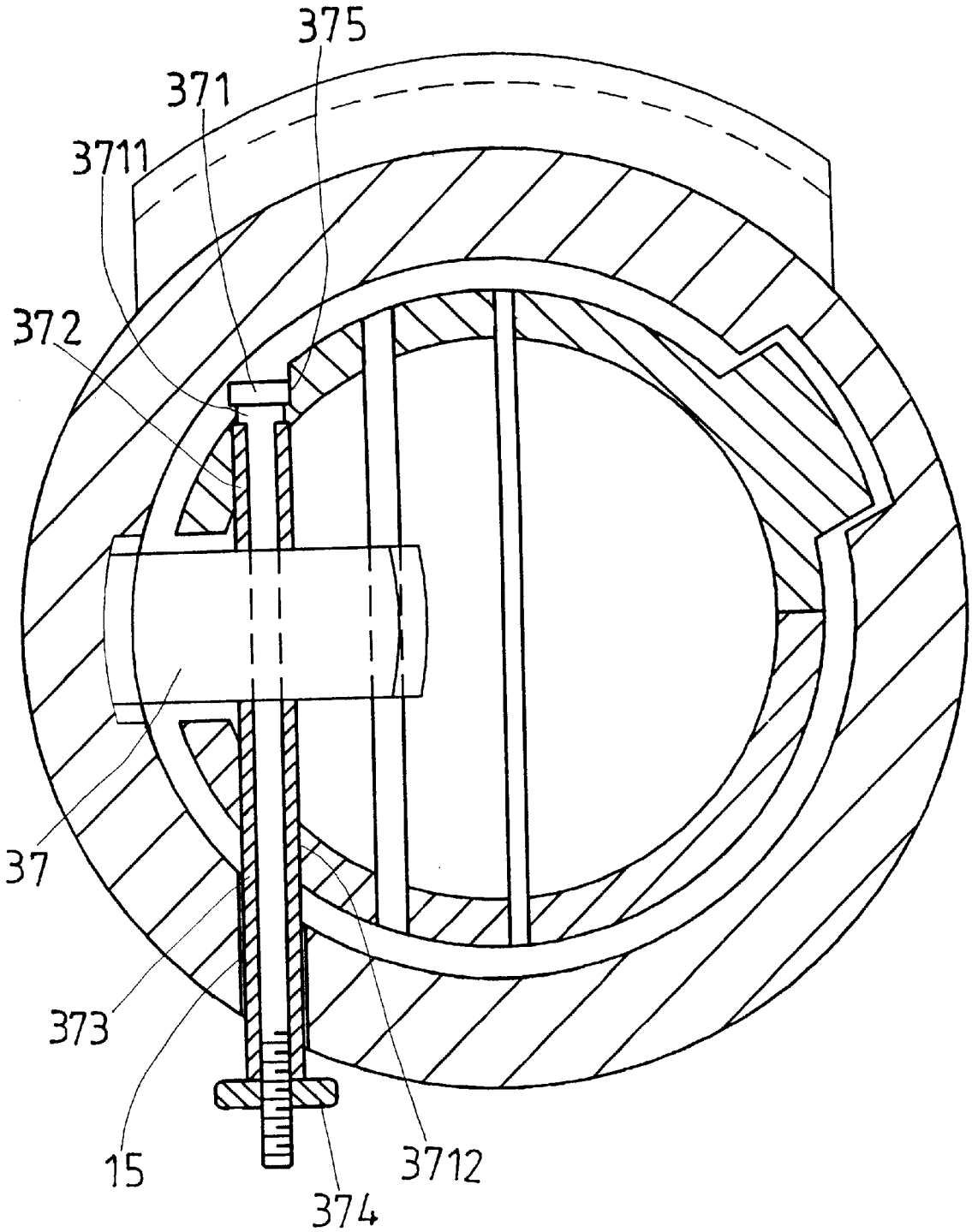
FIG. 10 is a top view of the adjustment device according a third embodiment of the present invention.

Referring to FIG. 10, the first cog 37 in FIG. 6 is provided with a bolt 371 instead of a pivot rod. The housing body 31 is provided with a locating hole 375, and a through hole 3712 for the bolt 371 to be passed therethrough. The locating hole 375 has a stair-like inner side such that a head (not numbered) of a locating end portion 3711 can be stopped from moving through the locating hole 375. Furthermore, the fixed tube member 1 has a through hole 15 for the bolt 371 to be passed therethrough. A rigid holding tube 372 is connected to the bolt 371 between the first cog 37 and the bolt head, while a soft holding tube 373 is connected to the bolt 371 between an outer end of the bolt 371 and the first cog 37. A nut 374 is screwed onto the bolt outer end. Thus, when the nut 374 is screwed towards the cog 37, same will force the soft holding tube 373 to contact and fix the cog 37; therefore, the adjustment member 3 is fixed in position because the cog 37 is stopped from turning by the holding tube 373.

The bolt 371 can be used alone. It can also be used the controlling lever 39 to fix the cog 37 of the adjustment member 3.

From the above description, the adjustment device for an arm of a chair can be seen to have a desirable feature: the user only has to push the controlling member or turn the nut for the arm to be movable so the adjustment device can be operated very easily.

What is claimed is:

1. An adjustment device for an arm of a chair, comprising a fixed tube member fixed to an upper side of a seat of said chair; said fixed tube member having upright trenches on an inner side thereof; said trenches each having a row of lined teeth thereon;

an inner tube having an upper part and a lower part; said inner tube being movably passed into said fixed tube member from said lower part; said upper part being coupled to a lower side of said arm of said chair;

an adjustment member, said adjustment member having a housing body connected to both said upper part and said lower part of said inner tube; said adjustment member having cogs each turnably supported on said housing body by a pivot rod; said cogs being each disposed on a respective one of said lined teeth of said fixed tube member; said adjustment member having an engaging member movably disposed on said cogs; said engaging member having engaging teeth opposing said cogs; said engaging member being biased downwardly by a spring received in said upper part of said inner tube in order for said engaging teeth to engage said cogs; a rope being connected to both said engaging member and a controlling member movably fitted on said arm for permitting said engaging member to be lifted and separated from said cogs when controlling member is pushed; said adjustment member and said inner tube being capable of moving along said fixed tube part when said engaging teeth separate from said cogs;

whereby said arm can be adjusted in respect of height thereof when said controlling member is pushed, and can be fixed in position when said controlling member is released.

2. An adjustment member for an arm of a chair, comprising a fixed tube member fixed to an upper side of a seat of said chairs; said fixed tube member having a first upright trench and a second upright confining trench on an inner side thereof; said first trench having lined teeth thereon;

an inner tube member having an upper part and a lower part; said inner tube member being movably passed into said fixed tube member from said lower part; said upper part being coupled to a lower side of said arm of said chair;

an adjustment member having a housing member connected to both said upper part and said lower part of said inner tube; said housing member having a gap opposing said lined teeth of said fixed tube member, and a protruding block movably received in said confining trench of said fixed tube member; said adjustment member having a first cog supported by a bolt; said first cog being disposed on said lined teeth; a second cog being provided adjacent to, and engaging said first cog; said second cog having a controlling lever separably connected thereto; said controlling lever having engaging teeth opposing said second cog; said controlling member being biased by a spring such that said engaging teeth engage said second cog to stop said first and said second cogs from turning; a rope being connected to said controlling lever, and a controlling member movably fitted to said arm such that said rope can pull said controlling lever for same to separate from said second cog and for said cogs to be turnable when said controlling member is pushed; said inner tube and said adjustment member being capable of moving along said fixed tube member when said cogs don't engage said engaging teeth of said lever;

whereby said arm can be adjusted in respect of height thereof when said controlling member is pushed, and can be fixed in position when said controlling member is released.

3. The adjustment member as claimed in claim 2, wherein said bolt of said first cog has a head located on a locating hole of said housing body of said adjustment member; said bolt being passed through said housing body and said fixed tube member from other end; said other end being screwed into a nut; said bolt being passed through a first holding tube disposed between said head and said first cog, and passed through a second holding tube disposed between said first cog and said nut;

whereby said second holding tube can stop said first cog from turning when said nut is screwed towards said first cog.

* * * * *